United States Patent [19]

Hirahata et al.

[11] 4,404,552

[45] Sep. 13, 1983

[54] DISPLAY DEVICE FOR BOTH A CHARACTER DISPLAY AND A GRAPHIC DISPLAY

[75] Inventors: Shigeru Hirahata; Tetsuya Ikeda; Tsuguji Tachiuchi; Shigeru Komatsu; Teruhiro Takezawa, all of Yokohama, Japan

[73] Assignee: Hitachi, Ltd., Tokyo, Japan

[21] Appl. No.: 220,142

[22] Filed: Dec. 23, 1980

[30] Foreign Application Priority Data

Dec. 27, 1979 [JP] Japan ..... 54-169414

[51] Int. Cl.[3] ..... G09G 1/16

[52] U.S. Cl. ..... 340/721; 340/747; 340/750

[58] Field of Search ..... 340/721, 792, 790, 747, 340/744, 789, 720, 750, 798

[56] References Cited

U.S. PATENT DOCUMENTS

| | | | |
|---|---|---|---|
| 4,122,533 | 10/1978 | Kubinak | 340/790 |
| 4,197,590 | 4/1980 | Sukonick | 340/721 |
| 4,297,693 | 10/1981 | Parsons | 340/721 |

OTHER PUBLICATIONS

"CRT Controller (CRTC) HD 46505R Users Manual," Published by Hitachi Limited, 1979, pp. 1–5, 45–52, 54–57.

*Primary Examiner*—Marshall M. Curtis
*Attorney, Agent, or Firm*—Kenyon & Kenyon

[57] ABSTRACT

In a display signal generating means in a display device for both the character display and the graphic display, address conversion means is provided for converting the addresses of one character in a plurality of lines of one character section of a memory field corresponding to a display panel into a predetermined address or addresses.

5 Claims, 17 Drawing Figures

| Fig. 1A | Fig. 1B |
|---|---|

ROW 1- Column 17 Section

| Fig. 5 A | Fig. 5 B | Fig. 5 C |
|---|---|---|

| Fig. 7A | Fig. 7B | Fig. 7C |
|---|---|---|

| Fig. 8A | Fig. 8B | Fig. 8C |
|---|---|---|

DISPLAY DEVICE FOR BOTH A CHARACTER DISPLAY AND A GRAPHIC DISPLAY

TECHNICAL FIELD

The present invention relates to a display device for both a character display and a graphic display.

BACKGROUND ART

A prior art display device for both a character display and a graphic display is illustrated in FIG. 1. The display panel of the cathode ray tube (CRT) used in the display device of FIG. 1 is illustrated in FIG. 2, and the memory field of the display device of FIG. 1 is illustrated in FIGS. 3 and 4.

In FIG. 3, the vertical length of the memory field is divided into 16 character rows and the horizontal length of the memory field is divided into 32 character columns, and hence the entire memory field is divided into 512 ($=32\times16$) sectional areas. Each of the sectional areas provides space for one character.

Each of the sectional areas consists of 96 picture elements (bits) which are arranged in 12 lines in the vertical direction and 8 bits in the horizontal direction. As an example, the composition of the sectional area "Row 1-Column 17" of the memory field of FIG. 3 is illustrated in FIG. 4.

Thus, the entire memory field consists of 49152 ($=512\times96$) picture elements, and simultaneously of 512 sectional areas.

The bit signal "1" causes the corresponding bit of the display panel of the CRT 1 as display means to be luminous while bit signal "0" causes the corresponding bit of the display panel of the CRT 1 as display means to remain non-luminous.

The display device of FIG. 1 comprises a central processor unit 1, a clock signal generator 2, a data bus 10, an address bus 11, a data RAM, a program ROM, a display signal generating circuit 5 and a CRT 6 as display means. The display signal generating circuit 5 comprises a circuit 51 for generating timing pulses for display, an address decoder circuit 52, an address switching circuit 53, a display RAM 54, a discrimination signal RAM 55, a character pattern ROM 56, a switching circuit 57, and a circuit 58 for converting parallel signals into series signals.

The central processor unit 1 conducts an operation of, for example, 1 through 8 bits parallel calculation. The address bus 11 consists of 16 parallel conductors. The data bus 10 consists of 8 parallel conductors, through which said 1 through 8 bits parallel calculation signal are communicated between the central processor unit 1 and each of the data RAM 3, the program ROM 4, the display RAM 54, and the discrimination signal RAM 55. In order to separate communications between the central processor unit 1 and the memories 3, 4, 54 and 55, different addresses are allotted to the memories 3, 4, 54 and 55. An example of the allotment of the addresses is illustrated in the portion (A) of FIG. 5. The addresses are expressed in hexadecimal numbers. In the present specification hexadecimal numbers are described with the indication "16".

The program ROM 4 stores the program for operating the display device of FIG. 1. The display RAM 54 stores the picture information in the positions of the display RAM 54 which correspond to the positions of the display panel (FIG. 2 and FIG. 3). The discrimination signal RAM 55 stores the information which discriminates whether the information in question of the display RAM is a graphic data or a character data. The character pattern ROM 56 stores picture pattern data for character data and converts only the character data from the display RAM 54 into picture pattern data.

The sequence of the addresses in the device of FIG. 1 is illustrated in FIG. 5. The addresses are expressed in hexadecimal numbers 000016 through FFFF16. The addresses from 000016 through OFFF16 are allotted for the data RAM 3. The addresses from 800016 through 97FF16 are allotted for the display RAM 54. The addresses from A00016 through B7FF16 are allotted for the discrimination RAM 55. The addresses from F00016 through FFFF16 are allotted for the program RAM. Such allotment is illustrated in portion (A) of FIG. 5.

The constitution of the address region A00016 through B7FF16 for the discrimination RAM is illustrated in the portion (B) of FIG. 5. The constitution of the address region 800016 through 97FF16 for the display RAM is illustrated in the portion (C) of FIG. 5. The constitution of the address regions for Row 1 is illustrated in the portions (D1) and (E1) of FIG. 5. The constitution of the address regions for Row 2 is illustrated in the portions (D2) and (E2) of FIG. 5.

The discrimination signals stored in the addresses from "00016" through "B7FF16" of the discrimination RAM 55 corresponds to the signals stored in the addresses from "800016" through "97FF16" of the display RAM 54. The value of the discrimination signal is "0" when the discrimination signal represents the character information, and is "1" when the discrimination signal represents the graphic information.

The information stored in the addresses from "800016" through "97FF16" of the display RAM 54 are read out simultaneously with the reading out of the information stored in the addresses from "A00016" through "B7FF16" of the discrimination RAM 55.

The upper four bits of the binary expressions of the above mentioned addresses are "10002" and "10102", where 2 indicates the binary expression. It is observed that only the third bit "0" from the top of "10002" is different from the third bit "1" from the top of "10102". Therefore, the display address signal of only the lower 13 bits, which is equal to 16 bits minus upper 3 bits, is supplied from the timing pulse generator 51 through the address switching circuit 53 to the load of the address switching circuit 53.

As illustrated in FIG. 5, in the device of FIG. 1, the character information in the form of the character code must be stored in every line of one section, e.g. in twelve lines of one section of the memory field of FIG. 3. However, although the repetitive storage of the character information is not indispensable, a longer time is required to conduct the writing-in of the information to memory devices. Such an extension of time for the operation of the central processor unit 1 prevents the display device from speeding-up its operation.

Also, it is disadvantageous that the display device of FIG. 1 requires a display RAM 54 and a discrimination signal RAM 55 both of a relatively large capacity which make the display device of FIG. 1 considerably expensive.

An example of prior art CRT display device for both the character display and the graphic display is disclosed in "CRT Controller (CRTC) HD46505R Users Manual", published by Hitachi Limited in 1979.

SUMMARY OF THE INVENTION

The present invention is directed to eliminate the above described disadvantages in the prior art display device.

In accordance with the present invention, there is provided a display device for both character display and graphic display including: a display means having a display panel on which both the character information and the graphic information are displayed a display signal generating means for supplying said display means with display signals a central processor unit for controlling said display signal generating means a program memory means for storing an operating program for said display device, and an address bus and a data bus for establishing communication between said central processor unit, said program memory means and said display signal generating means; said display signal generating means comprising: a timing pulse generating means, an address switching means for switching address signals from said central processor unit and address signals from said timing pulse generating means, a display memory means for storing plural kinds of picture information, a discrimination signal memory means for storing and supplying the signal indicating the kind of said picture information, a character pattern memory means receiving signals from said display memory means and producing pattern data corresponding to the character information, and a switching means for switching signals from said display memory means and signals from said character pattern memory means under the control of signals from said discrimination signal memory means; characterized in that: an address conversion means is provided between said address switching means and said display memory means, address signals produced from said address switching means being supplied both to said address conversion means and said discrimination signal memory means, discrimination signals produced from said discrimination signal memory means being supplied to said address conversion means to control the address conversion in said address conversion means for supplying output signals to said display memory means.

DESCRIPTION OF THE PREFERRED EMBODIMENT

Figure 6A:
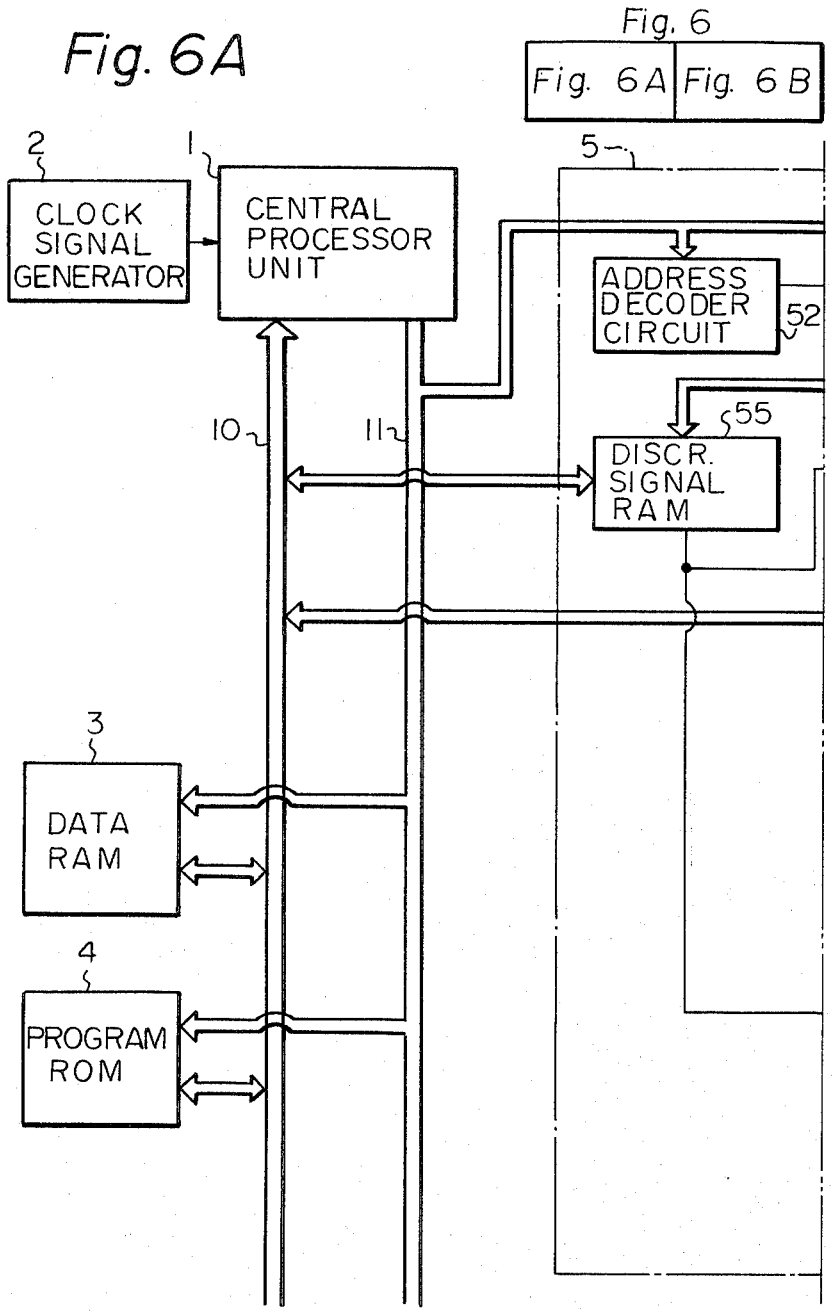
Figure 6B:
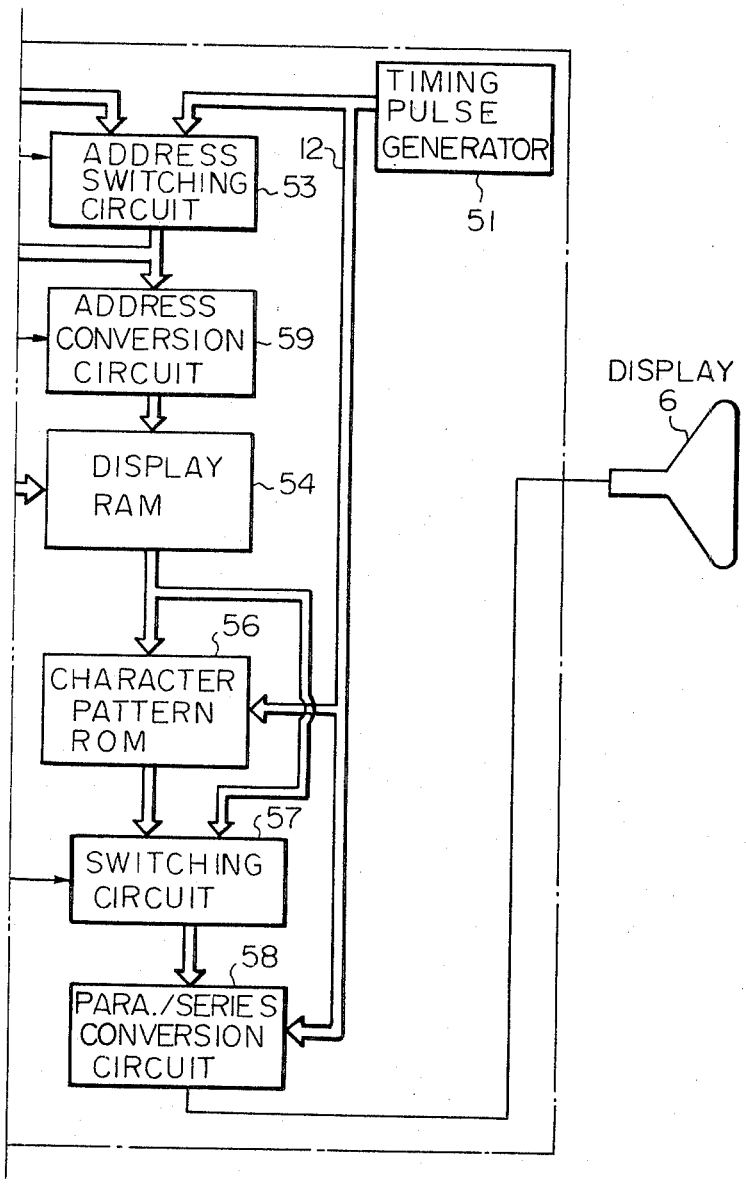

A display device for both the character display and the graphic display as an embodiment of the present invention is illustrated in FIG. 6. The display panel and the memory field of the display device of FIG. 6 are the same as the display panel of the display illustrated in FIG. 2 and the memory field illustrated in FIGS. 3 and 4, respectively.

Figure 3:
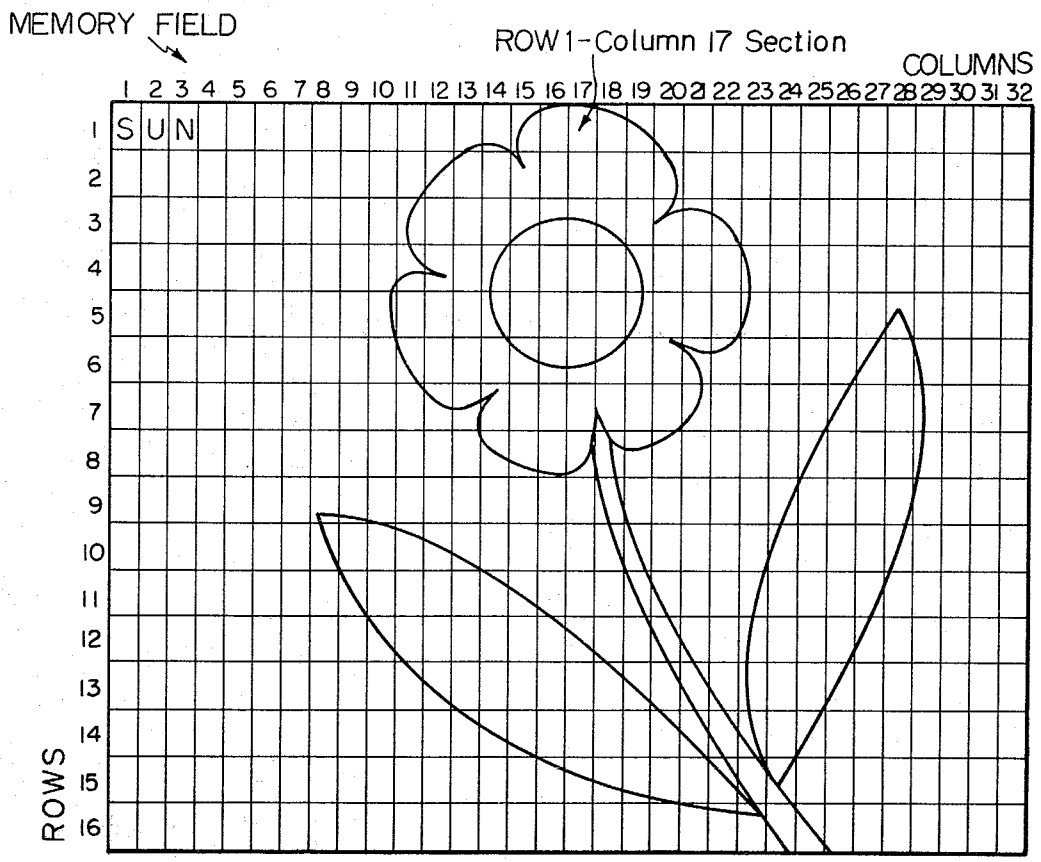

In FIG. 3, the vertical length of the memory field is divided into 16 character rows and the horizontal length of the memory field is divided into 32 character columns, and hence the entire memory field is divided into 512 ($=32\times16$) sectional area. Each of the sectional areas provides space for one character.

Figure 4:
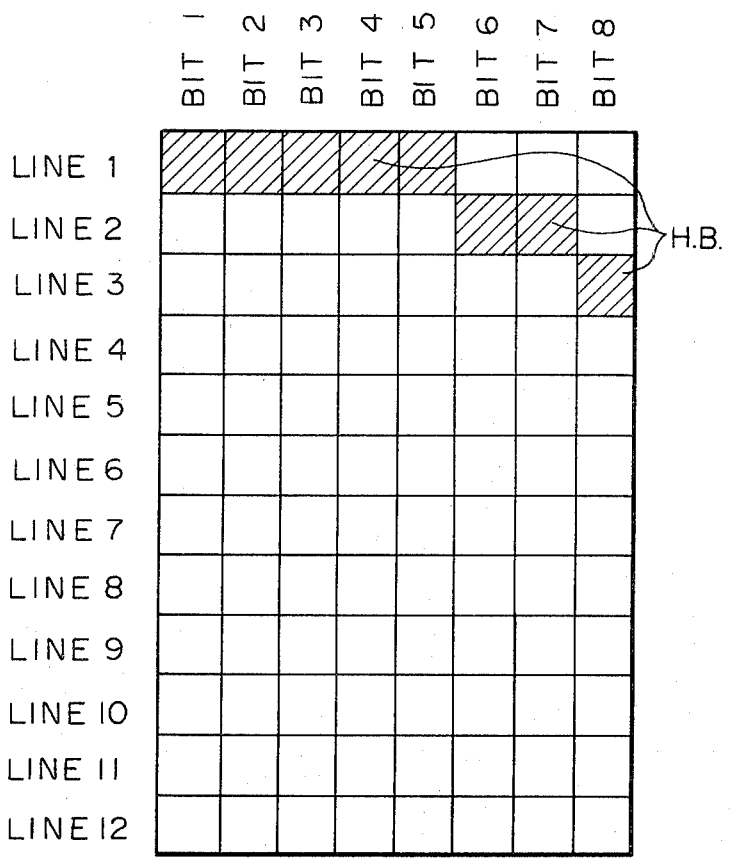
Figures 5, 5A:
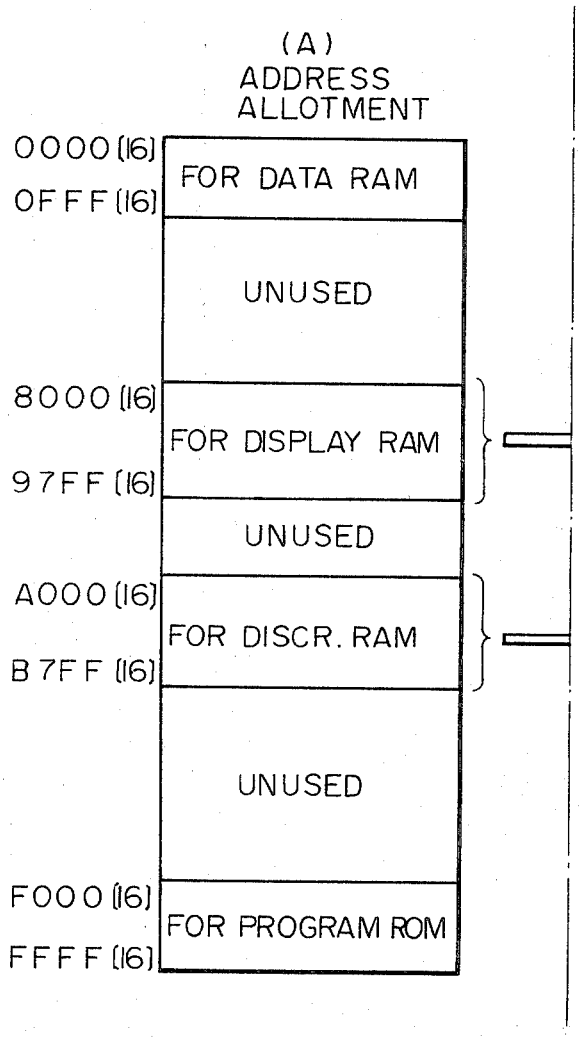
Fig. 5 PRIOR ART
Figure 5B:
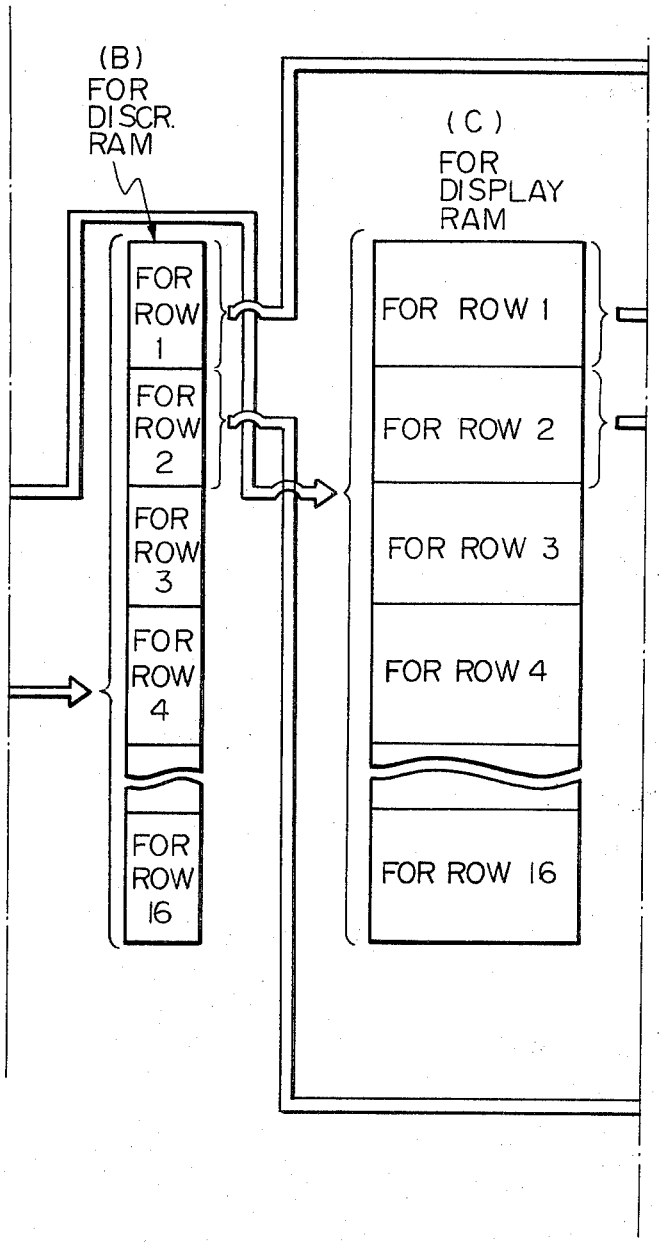
Figure 5C:
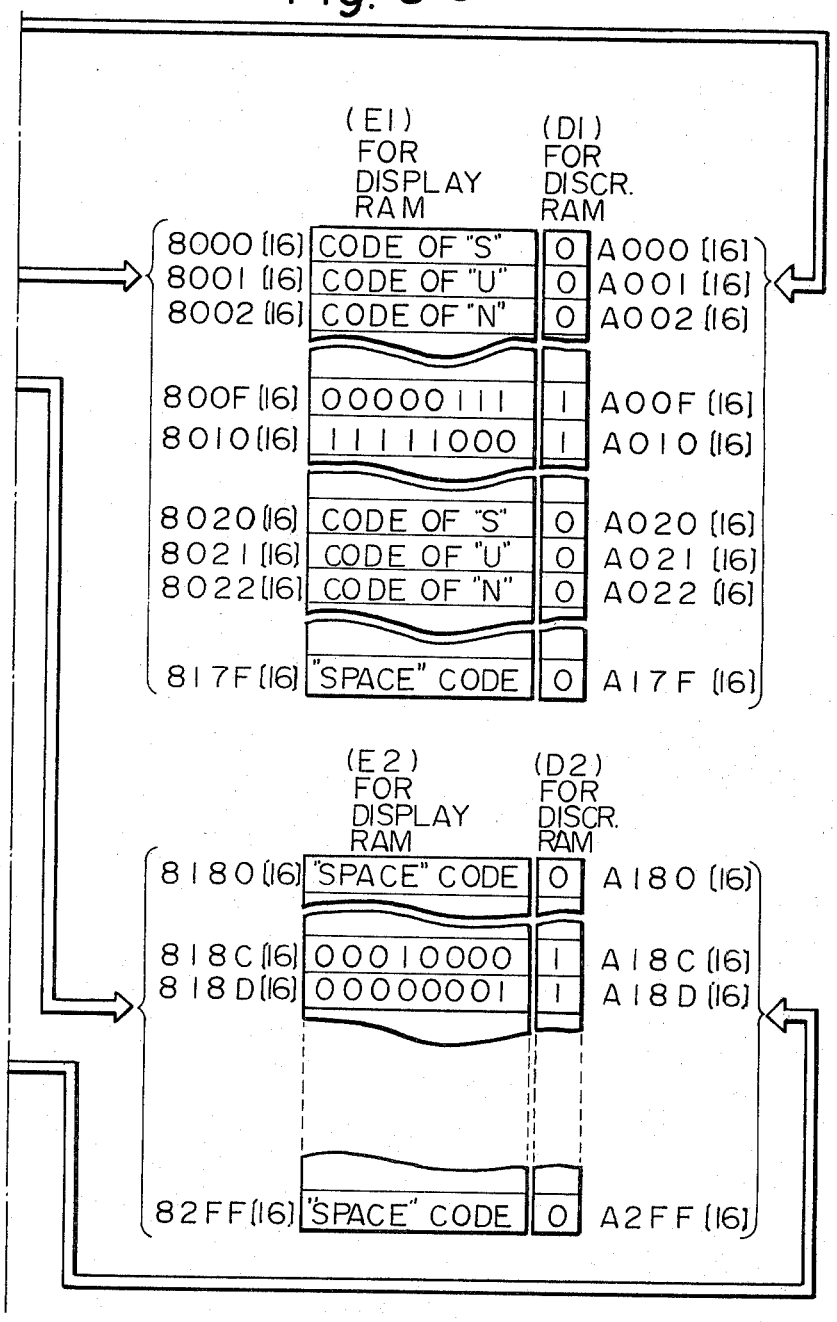

Each of the sectional areas consists of 96 picture elements, pixels which are arranged in 12 lines in the vertical direction and 8 pixels in the horizontal direction. As an example, the composition of the sectional area "Row 1-Column 17" of the memory field of FIG. 3 is illustrated in FIG. 4.

Thus, the entire memory field consists of 49,152 ($=512\times96$) picture elements, and simultaneously of 512 sectional areas.

The bit signal "1" causes the corresponding bit of the display panel of the CRT 1 as display means to be luminous, while bit signal "0" causes the corresponding bit of the display panel of the CRT 1 as display means to remain non-luminous.

The display device of FIG. 6 comprises a central processor unit 1, a clock signal generator 2, a data bus 10, an address bus 11, a data RAM, a program ROM, a display signal generating circuit 5 and a CRT 6 as a display means. The display signal generating circuit 5 comprises a circuit 51 for generating timing pulses for display, an address decoder circuit 52, an address switching circuit 53, a display RAM 54, a discrimination signal RAM 55, a character pattern ROM 56, a switching circuit 57, a circuit 58 for converting parallel signals into series signals and an address conversion circuit 59.

The central processor unit 1 conducts an operation of, for example, 1 through 8 bits parallel calculation. The address bus 11 consists of 16 parallel conductors. The data bus 10 consists of 8 parallel conductors, through which said 1 through 8 bits parallel calculation signals are communicated between the central processor unit 1 and each of the data RAM 3, the program ROM 4, the display RAM 54, and the discrimination signal RAM 55. In order to separate communications between the central processor unit 1 and the memories 3, 4, 54 and 55, different addresses are allotted to the memories 3, 4, 54 and 55. An example of the allotment of the addresses is illustrated in the portion (A) of FIG. 7. The addresses are expressed in hexadecimal numbers.

Figures 1, 1A:
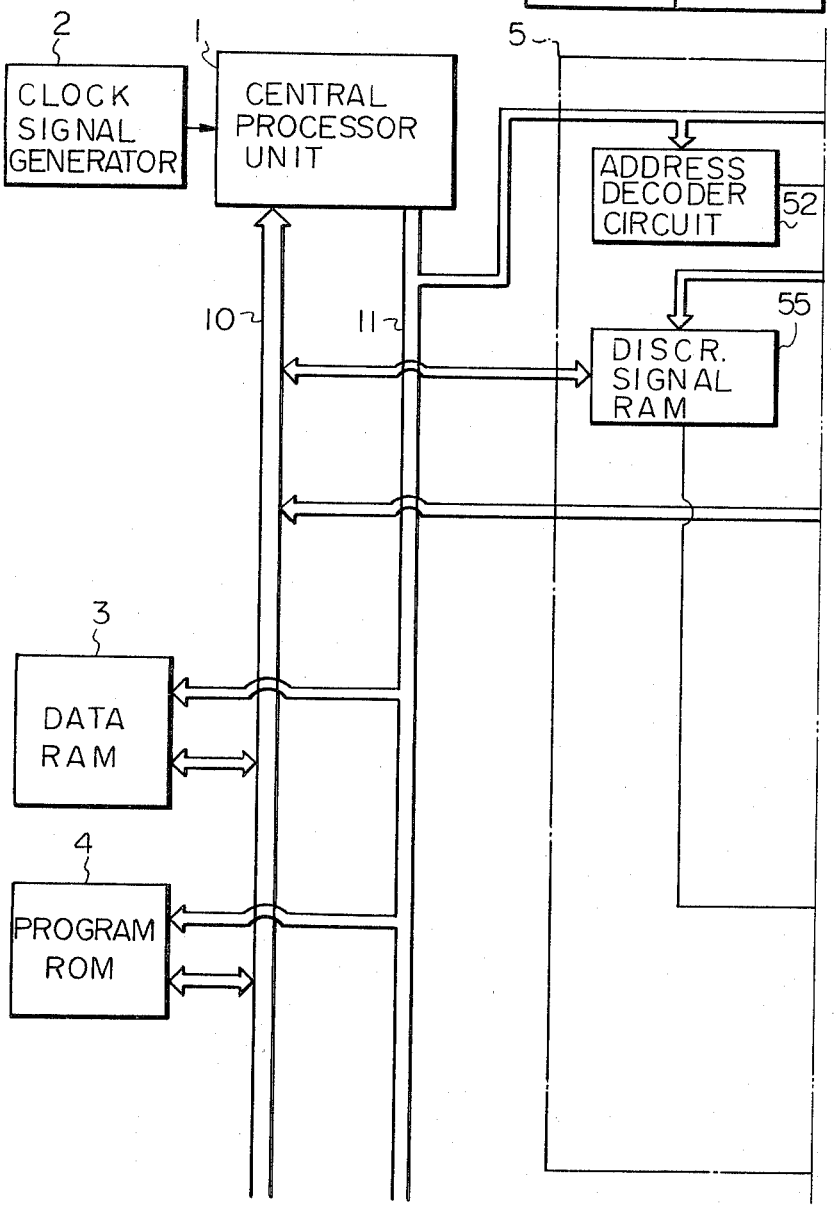
Fig. 1 PRIOR ART
FIG. 1, including 1A and 1B, illustrates a diagram of the circuits of a prior art display device.
Figure 1B:
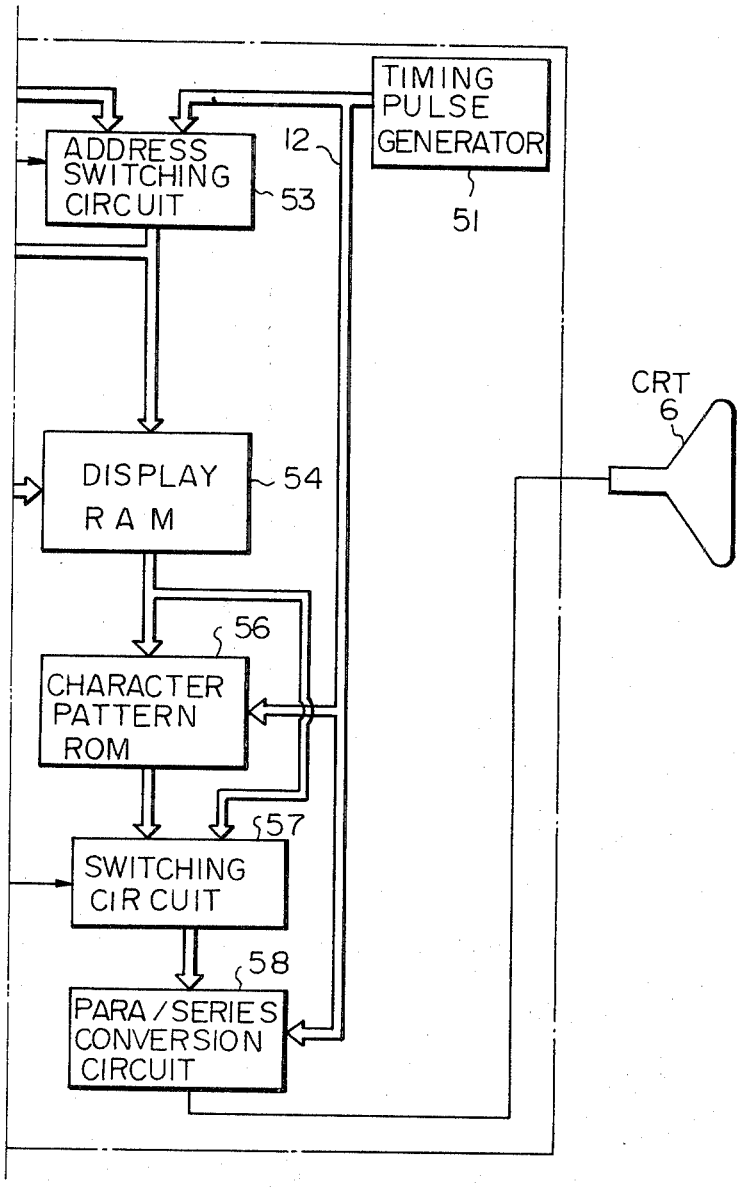
Figure 2:
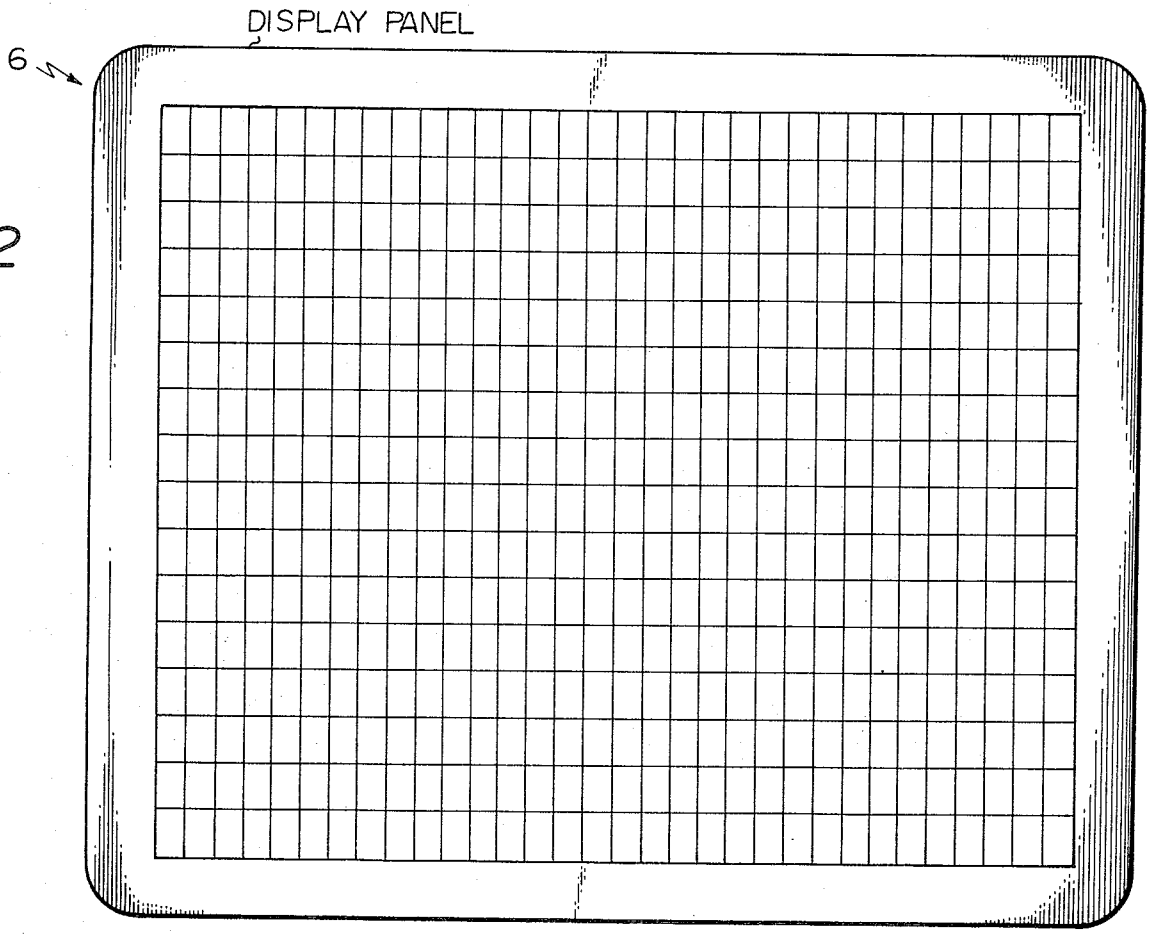
FIG. 2 illustrates the display panel of the display device of FIG. 1, FIGS. 3 and 4 illustrate the memory field of the display device of FIG. 1, FIG. 5, including 5A and 5B, illustrates the sequence of the addresses of the display device of FIG. 1, FIG. 6, including 6A and 6B, illustrates a diagram of the circuits of a display device in accordance with an embodiment of the present invention, FIGS. 7 and 8, including 7A through 8C, illustrate the sequence of the addressses of the display device of FIG. 6.

The program ROM 4 stores the program for operating the display device of FIG. 6. The display RAM 54 stores the picture information in the positions of the display RAM 54 which correspond to the positions of the display panel (FIG. 2 and FIG. 3). The discrimination signal RAM 55 stores the information which discriminates whether the information in question of the display RAM is graphic data or character data. The character pattern ROM 56 stores picture pattern data for character data and converts only the character data from the display RAM 54 into picture pattern data.

Figures 7, 7A:
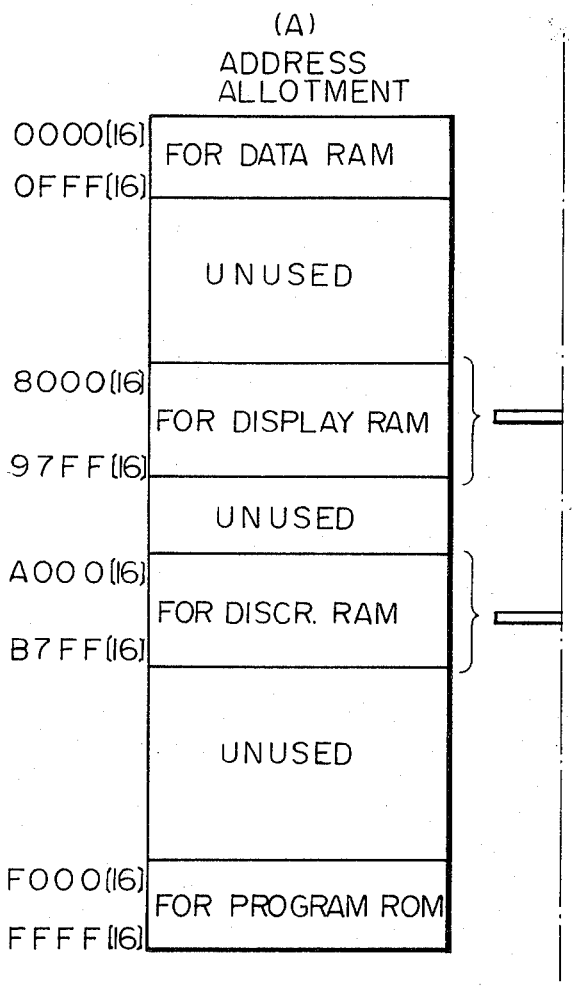
Figure 7B:
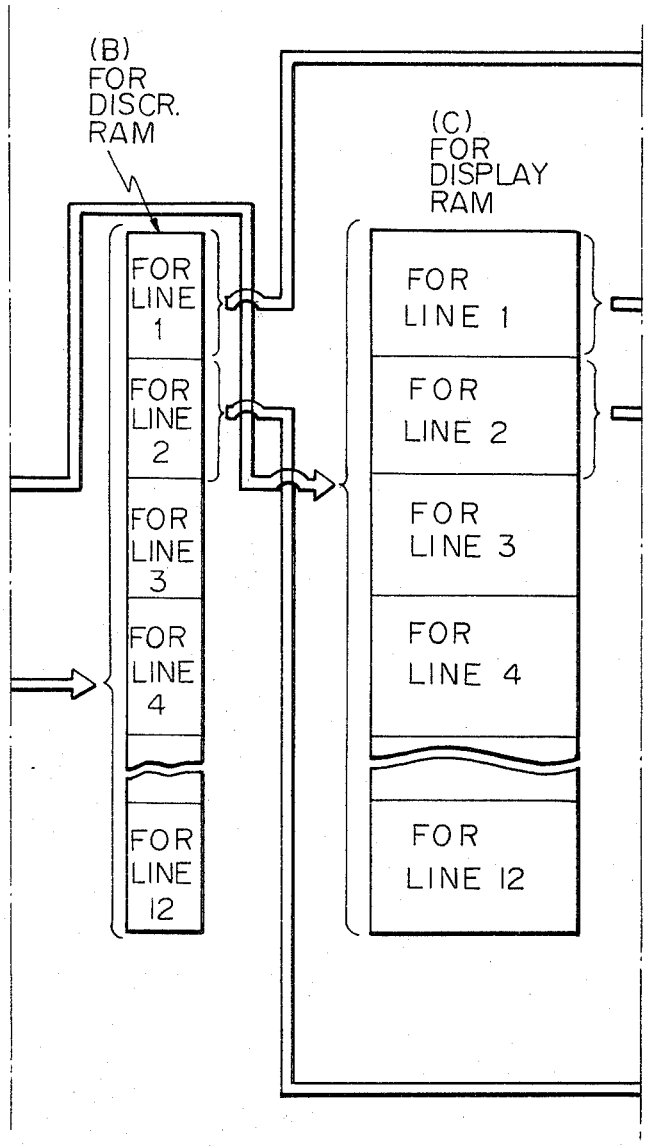
Figure 7C:
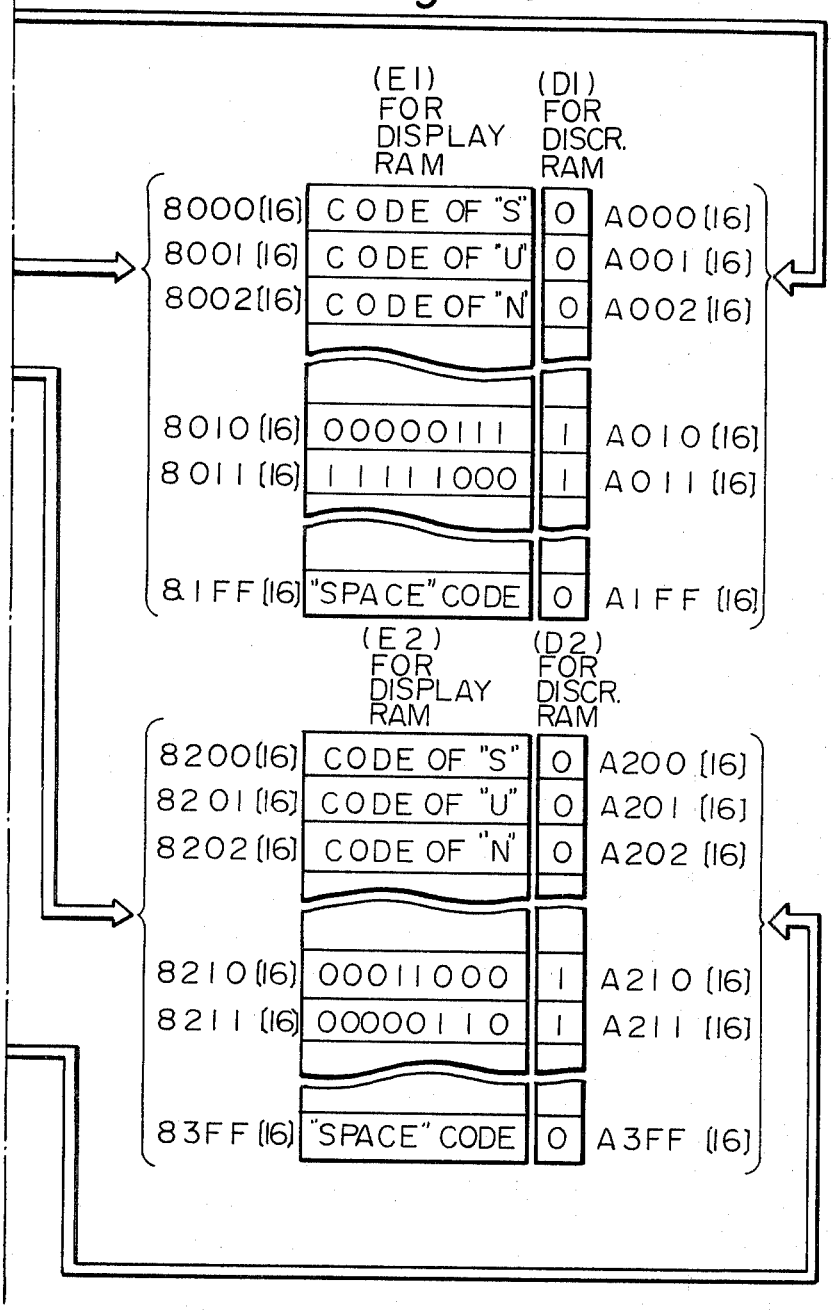

The sequence of the addresses in the device of FIG. 6 is illustrated in FIG. 7. The addresses are expressed in hexadecimal numbers 000016 through FFFF16. The addresses from 000016 through OFFF16 are allotted for the data RAM 3. The addresses from 800016 through 97FF16 are allotted for the display RAM 54. The addresses from A00016 through B7FF16 are allotted for the discrimination RAM 55. The addresses from F00016 through FFFF16 are allotted for the program RAM. Such allotment is illustrated in portion (A) of FIG. 7.

The constitution of the address region A00016 through B7FF16 for the discrimination RAM is illustrated in portion (B) of FIG. 7. The constitution of the address region 800016 through 97FF16 for the display RAM is illustrated in portion (C) of FIG. 7. The constitution of the address regions for Line 1 is illustrated in portions (D1) and (E1) of FIG. 7. The constitution of the address regions for Line 2 is illustrated in the portions (D2) and (E2) of FIG. 7. As illustrated in portions (D1) and (E1) of FIG. 7, the character information and the graphic information for Line 1 of the entire sections are stored in addresses 800016 through 81FF16.

It is assumed that the information of characters "S", "U" and "N" is stored in ROW 1, Columns 1, 2 and 3 of the memory field, and the information of a graphical figure of a flower is stored in the predetermined sectional areas of the memory field corresponding to the contour of said flower, as illustrated in FIG. 3. The hatched bits H.B. in FIG. 4 represent a portion of the contour of said flower. Each of the hatched bits H.B. corresponds to the signal "1". The non-hatched bits in FIG. 4 represent the space. Each of the non-hatched bits in FIG. 4 corresponds to the signal "0".

The character information such as the codes of "S", "U" and "N" is stored in the addresses 800016, 800116 and 800216, and the graphic information such as "00000111" and "11111000" is stored in the addresses 801016 and 801116. Also, the character information and the graphic information for Line 2 of the entire memory filed is stored in addresses 820016 through 83FF16.

Also, as illustrated in the portions (D2) and (E2) of FIG. 7, the character information and the graphic information for Line 2 of the entire memory field is stored in addresses 820016 through 83FF16.

In the device of FIG. 6, an address conversion circuit 59 is inserted between the address switching circuit 53 and the display RAM 54. The address conversion circuit 53 is controlled by the output of the discrimination signal RAM 55. When the output indicating character information is produced in the discrimination signal RAM 55 and supplied to the address conversion circuit 59, the address conversion circuit 59 converts the address in which the character information of Line N (N=1, 2, . . . 12) is stored into the address in which the character information of Line 1 is stored. While, when the output indicating graphic information is produced in the discrimination signal RAM 55 and supplied to the address conversion circuit 59, no conversion is carried out by the address conversion circuit 59.

Figures 8, 8A:
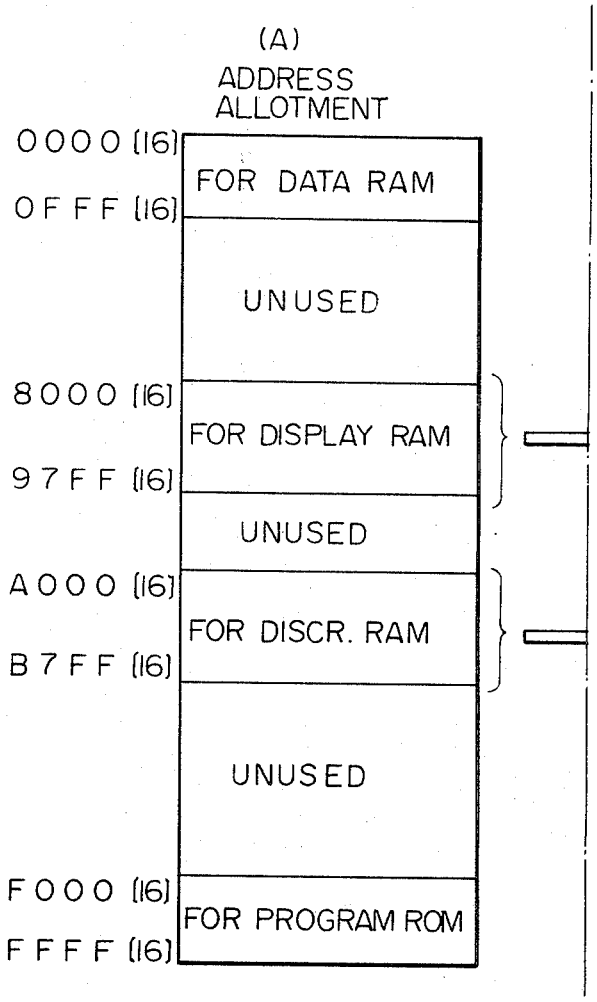
Figure 8B:
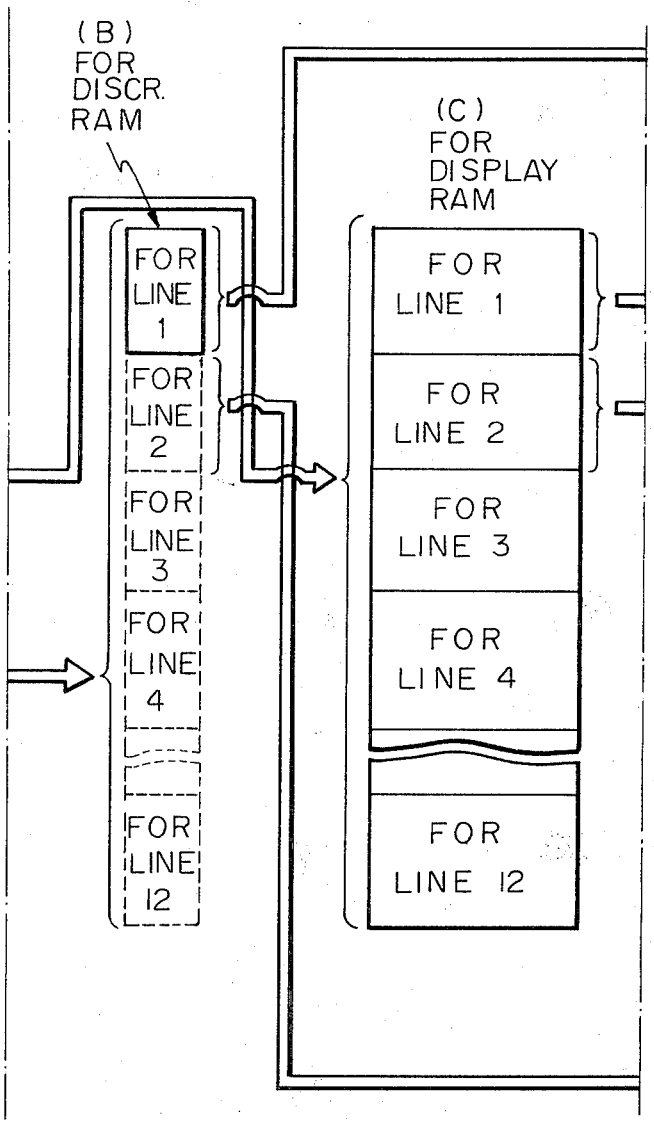
Figure 8C:
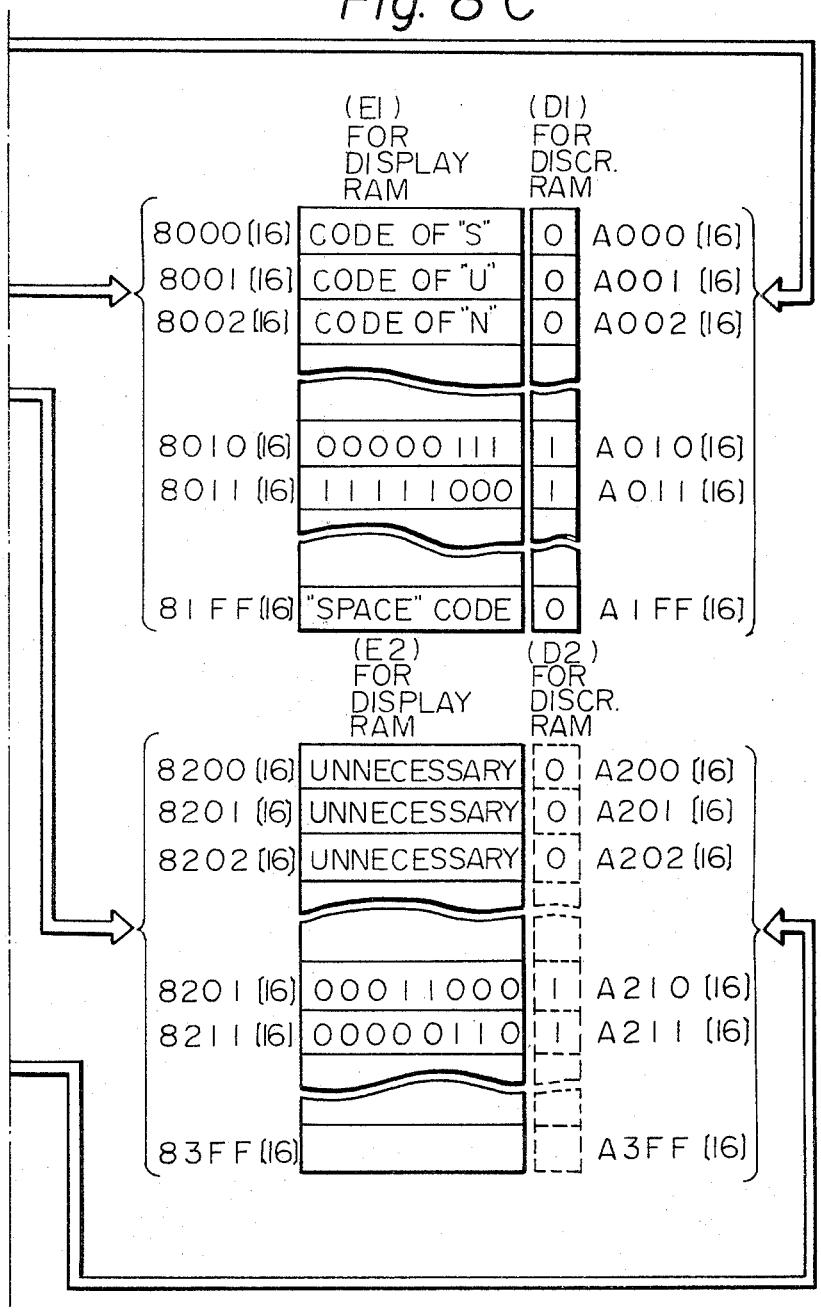

As illustrated in portion (D2) of FIG. 8, when the output signals "0" which indicate character signals are supplied to the (D2) addresses A20016, A20116 and A20216 which correspond to the (E2) addresses 820016, 820116 and 820216, the (E2) addresses 820016, 820116 and 820216 are converted into the (E2) addresses 800016, 800116 and 800216. Due to such address conversion, character codes are not necessary in the (D2) addresses A20016 through A20216 which correspond to the (E2) addresses 820016 through 820216.

An example of the address conversion is indicated in Lists A and b mentioned below, where the addresses for the character "S" before the conversion are indicated in List A and the addresses for the character "S" after the conversion are indicated in List B.

List A. Before Conversion

| Line Number | Address for Character "S" | The Lower 13 Bits in Binary Representation of the Address | | | | | | | | | | | | |
|---|---|---|---|---|---|---|---|---|---|---|---|---|---|---|
| | | (13) | (12) | (11) | (10) | (9) | (8) | (7) | (6) | (5) | (4) | (3) | (2) | (1) |
| Line 1 | 800016 | 0 | 0 | 0 | 0 | 0 | 0 | 0 | 0 | 0 | 0 | 0 | 0 | 0 |
| Line 2 | 820016 | 0 | 0 | 0 | 1 | 0 | 0 | 0 | 0 | 0 | 0 | 0 | 0 | 0 |
| Line 3 | 840016 | 0 | 0 | 1 | 0 | 0 | 0 | 0 | 0 | 0 | 0 | 0 | 0 | 0 |
| Line 4 | 860016 | 0 | 0 | 1 | 1 | 0 | 0 | 0 | 0 | 0 | 0 | 0 | 0 | 0 |
| Line 5 | 880016 | 0 | 1 | 0 | 0 | 0 | 0 | 0 | 0 | 0 | 0 | 0 | 0 | 0 |
| Line 6 | 8A0016 | 0 | 1 | 0 | 1 | 0 | 0 | 0 | 0 | 0 | 0 | 0 | 0 | 0 |
| Line 7 | 8C0016 | 0 | 1 | 1 | 0 | 0 | 0 | 0 | 0 | 0 | 0 | 0 | 0 | 0 |
| Line 8 | 8E0016 | 0 | 1 | 1 | 1 | 0 | 0 | 0 | 0 | 0 | 0 | 0 | 0 | 0 |
| Line 9 | 900016 | 1 | 0 | 0 | 0 | 0 | 0 | 0 | 0 | 0 | 0 | 0 | 0 | 0 |
| Line 10 | 920016 | 1 | 0 | 0 | 1 | 0 | 0 | 0 | 0 | 0 | 0 | 0 | 0 | 0 |
| Line 11 | 940016 | 1 | 0 | 1 | 0 | 0 | 0 | 0 | 0 | 0 | 0 | 0 | 0 | 0 |
| Line 12 | 960016 | 1 | 0 | 1 | 1 | 0 | 0 | 0 | 0 | 0 | 0 | 0 | 0 | 0 |

List B. After Conversion

| Line Number | Address for Character "S" | The Lower 13 Bits in Binary Representation of the Address | | | | | | | | | | | | |
|---|---|---|---|---|---|---|---|---|---|---|---|---|---|---|
| | | (13) | (12) | (11) | (10) | (9) | (8) | (7) | (6) | (5) | (4) | (3) | (2) | (1) |
| Line 1 | 800016 | 0 | 0 | 0 | 0 | 0 | 0 | 0 | 0 | 0 | 0 | 0 | 0 | 0 |
| Line 2 | 800016 | 0 | 0 | 0 | 0 | 0 | 0 | 0 | 0 | 0 | 0 | 0 | 0 | 0 |
| Line 3 | 800016 | 0 | 0 | 0 | 0 | 0 | 0 | 0 | 0 | 0 | 0 | 0 | 0 | 0 |
| Line 4 | 800016 | 0 | 0 | 0 | 0 | 0 | 0 | 0 | 0 | 0 | 0 | 0 | 0 | 0 |
| Line 5 | 800016 | 0 | 0 | 0 | 0 | 0 | 0 | 0 | 0 | 0 | 0 | 0 | 0 | 0 |
| Line 6 | 800016 | 0 | 0 | 0 | 0 | 0 | 0 | 0 | 0 | 0 | 0 | 0 | 0 | 0 |
| Line 7 | 800016 | 0 | 0 | 0 | 0 | 0 | 0 | 0 | 0 | 0 | 0 | 0 | 0 | 0 |
| Line 8 | 800016 | 0 | 0 | 0 | 0 | 0 | 0 | 0 | 0 | 0 | 0 | 0 | 0 | 0 |
| Line 9 | 800016 | 0 | 0 | 0 | 0 | 0 | 0 | 0 | 0 | 0 | 0 | 0 | 0 | 0 |
| Line 10 | 800016 | 0 | 0 | 0 | 0 | 0 | 0 | 0 | 0 | 0 | 0 | 0 | 0 | 0 |
| Line 11 | 800016 | 0 | 0 | 0 | 0 | 0 | 0 | 0 | 0 | 0 | 0 | 0 | 0 | 0 |
| Line 12 | 800016 | 0 | 0 | 0 | 0 | 0 | 0 | 0 | 0 | 0 | 0 | 0 | 0 | 0 |

Figure 9:
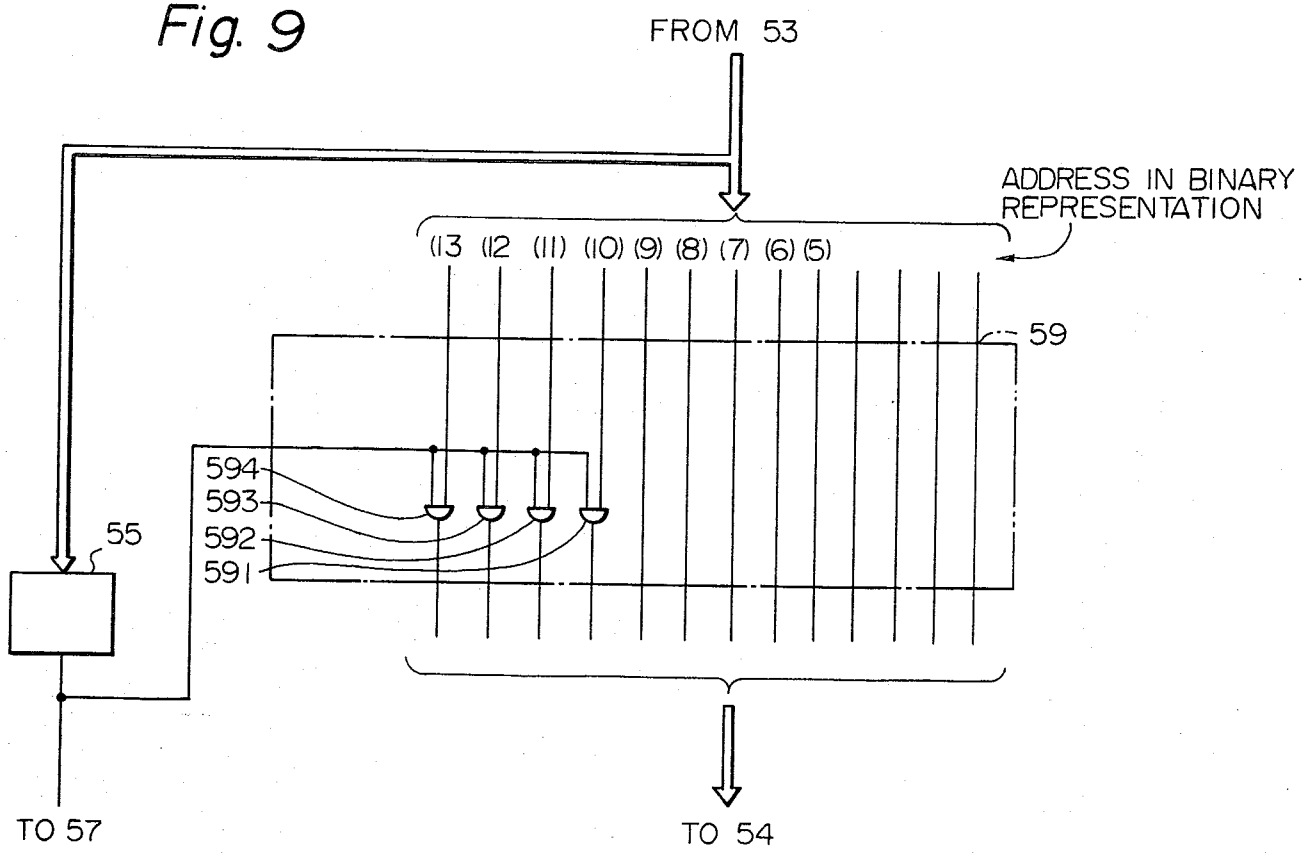
FIG. 9 illustrates the diagram of the address conversion circuit used in the display device of FIG. 6.

The above described address conversion can be carried out by a conversion circuit illustrated in FIG. 9. In the circuit of FIG. 9, the AND gates 591, 592, 593 and 594 are caused to be in the "OFF" state only when the Discrimination Signal RAM 55 supplies the signal "0", so that the conversion of the signals of the 10th through the 13th bits of the addresses in binary representation is carried out.

In the display device of FIG. 6, no information is required to be stored in the addresses such as 820016, 820116 and 820216. Accordingly, the processing time of the central processor unit 1 can be greatly reduced. Also, the capacity of the discrimination signal RAM 55 can be greatly reduced.

With regard to the address capacity of the discrimination signal RAM 55, it is possible to reduce the address capacity down to the number of bits equal to the number of characters which can be displayed on the display panel. This is because the discrimination signal for Line No. 1 of one character section can be used as the discrimination signal for Line No. N, where N is one of 1 through 12, of said character section. Such a reduction of the address capacity of the discrimination signal RAM 55 is advantageous. The illustration of the portion (B) and (D2) of FIG. 8 in broken lines expresses the capability of the omission of the information in the portion (B) and (D2).

In the above embodiment of the present invention, the signal supplied to the CRT 6 is the luminance signal. However, it is possible to supply the CRT 6 with a color signal. When such a color signal is used, three display RAMs for red, green and blue signals are provided.

We claim:

1. In a display device for both character display and graphic display including:

a display means having a display panel on which both the character information and the graphic information are displayed at areas, each area including pixels with the pixels arranged in a pixel line, a display signal generating means for supplying said display means with display signals;

a central processor unit for controlling said display signal generating means, a program memory means for storing an operating program for said display device, and an address bus and a data bus for establishing communication between said central processor unit, said program memory means and said display signal generating means;

said display signal generating means comprising;

a timing pulse generating means, an address switching means for switching address signals from said central processor unit and address signals from said timing pulse generating means, a display memory means capable of storing picture information for each pixel, character information being stored in the form of character codes and the graphic information in the form of pixel pattern data in the predetermined addresses of the sections of the memory field, the same character codes being used for the pixel lines belonging to one character area and the respective pattern data being used for area including the contour of graphic figure, a discrimination signal memory means for storing and supplying the signal indicating the kind of said picture information, either character or pattern, a character pattern memory means receiving signals from said display memory means and producing pixel pattern data corresponding to the character information, and a switching means for switching signals from said display memory means and signals from said character pattern memory means under the control of signals from said discrimination signal memory means, the improvement comprising:

an address conversion means receiving inputs from said address switching means and providing outputs to said display memory means, discrimination signals produced from said discrimination signal memory means being supplied to said address conversion means to control the address conversion in said address conversion means for supplying output signals to said display memory means, such that said address conversion means, when the output of said discrimination memory means is indicative of a character, converting addresses of a plurality of pixel lines belonging to one character area into a single predetermined address or a number of addresses smaller than said plurality, and address signals produced from said address switching means being supplied both to said address conversion means and said discrimination signals memory means.

2. A display device as defined in claim 1, wherein the sequence of the addresses for the display memory means is arranged in the sequence from the addresses for pixel line No. 1 through pixel line No. n of a area of the memory field, where n is the number of the pixel lines including in one character area of the memory field corresponding to the display panel.

3. A display device as defined in claim 1, wherein a discrimination signal memory having the reduced address capacity is used for said discrimination signal memory means.

4. A display system capable of displaying both character and graphic patterns including:

a display means including a display screen for displaying both the character and graphic patterns on said screen, a display signal generating means for supplying display signals to said display means, a central processor unit for controlling said display signal generating means, and;

a program memory means for storing an operating program for said central processor unit;

said display signal generating means comprising:

a timing pulse generating means for generating timing pulses for said display signal generating means, an address switching means receiving address signals from said central processor unit and address signals from said timing pulse generating means for selectively outputting address signals from either said central processor unit or said timing pulse generating means, a display memory means for storing and outputting code signals representative of the character patterns and pattern signals representative of said graphic patterns, a discrimination signal memory means for storing and outputting selection signals each corresponding to each of the signals to be stored in said display memory means and indicating whether the corresponding signal to be stored in said display memory means is a code or a pattern signal, a character generator receiving code signals from said display memory means and timing pulses from said timing pulse generating means and operatively producing pattern data corresponding to said character patterns, an address conversion means provided between said address switching means and said display memory means for receiving address signals from said address switching means as well as selection signals corresponding to address signals supplied thereto to operatively convert a set of address signals designating a set of memory locations in which the same code signals representative of one character pattern on said screen are to be stored into a representative one of said set of address signals, when said selection signal indicates a character code and to pass the address signals from said address switching means unchanged when said selection signal indicates a pixel pattern signal, providing its output to said display memory means and;

a switching means for selectively supplying said display means either with pattern data from said display memory means when said selection signal indicates a pattern signal or with pattern data from said character generator when said selection signal indicate a code signal.

5. A display signal generating device of a display system capable of displaying both character and graphic patterns on a display screen for operatively exhibiting a television raster scan line pattern, each character pattern being displayed in one unitary space of said screen which is divided into a plurality of unitary spaces arranged in pixel lines and columns in a matrix form, said raster scan line scanning on said unitary spaces of respective pixel line thereof one after another, and successive scanning of said raster scan line being shifted on each unitary space so that each said unitary space is scanned thereon with a predetermined number of said raster scan lines, comprising:

(a) a first memory means having a plurality of addressible storage locations assigned to respective raster scan lines on each of said unitary spaces for operatively storing and outputting either a code signal representative of a code data or a pixel pattern signal representative of a graphic pattern data, (b) a second memory means having a plurality of addressible storage locations each assigned to correspond to each of said addressible storage locations of said first memory means for operatively storing and outputting selection signals each of which identifies whether signals stored in the corresponding storage location of the first memory means is a code signal or a pattern signal, (c) a first addressing means for supplying first address signals to said first memory means as well as second address signals to said second memory means, said first address signals designating respective storage locations of said first memory means, said second address signals designating respective storage locations of said second memory means which corresponds to respective addressed storage locations of said first memory means, and;

(d) an address conversion means receiving inputs from said first addressing means and providing outputs to said first memory means so as to receive said first address signals from said first addressing means and connected to said second memory means so as to receive said selection signals from said second memory means, said address conversion means operatively converting a set of said first address signals addressing a set of storage locations of said first memory means which represent a set of said raster scan lines covering one unitary space into one representative address signal among said set of said first address signals only when said selection signal supplied from said second memory means identifies to be a code signal, and said address conversion means operatively providing no address conversion onto said first address signal when said selection signal identifies to be a pixel pattern signal, and the thus non-converted first address signals and said converted representative address signals being supplied to said first memory means.

* * * * *

UNITED STATES PATENT AND TRADEMARK OFFICE

CERTIFICATE OF CORRECTION

PATENT NO. : 4,404,552

DATED : September 13, 1983

INVENTOR(S) : Shigeru Hirahata, et al.

It is certified that error appears in the above—identified patent and that said Letters Patent is hereby corrected as shown below:

In each instance where a number terminates in "16", the "16" should be a subscript.

Also, each instance where a number ends in "2", the "2" should be a subscript.

Col. 1, line 62, change "indication "16"" to the subscript --$_{16}$--.

Col. 2, line 27, change "00016" to --$A000_{16}$--.

Col. 4, line 11, before "lines" insert --pixel--.

Signed and Sealed this

Twenty-ninth Day of November 1983

[SEAL]

Attest:

GERALD J. MOSSINGHOFF

Attesting Officer

Commissioner of Patents and Trademarks